US010431359B2

(12) United States Patent
Uesaka et al.

(10) Patent No.: US 10,431,359 B2
(45) Date of Patent: Oct. 1, 2019

(54) METHOD FOR PRODUCING GRAIN-ORIENTED ELECTRICAL STEEL SHEET

(71) Applicant: JFE STEEL CORPORATION, Chiyoda-ku, Tokyo (JP)

(72) Inventors: Masanori Uesaka, Tokyo (JP); Minoru Takashima, Tokyo (JP); Takeshi Imamura, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 606 days.

(21) Appl. No.: 14/770,620

(22) PCT Filed: Feb. 27, 2013

(86) PCT No.: PCT/JP2013/055081
§ 371 (c)(1),
(2) Date: Aug. 26, 2015

(87) PCT Pub. No.: WO2014/132354
PCT Pub. Date: Sep. 4, 2014

(65) Prior Publication Data
US 2016/0012948 A1 Jan. 14, 2016

(51) Int. Cl.
*H01F 1/147* (2006.01)
*C21D 9/46* (2006.01)
(Continued)

(52) U.S. Cl.
CPC ..... *H01F 1/14775* (2013.01); *C21D 1/26* (2013.01); *C21D 8/1222* (2013.01);
(Continued)

(58) Field of Classification Search
None
See application file for complete search history.

(56) References Cited

U.S. PATENT DOCUMENTS 4,127,429 A * 11/1978 Ichida ..... C21D 8/1272 148/113
5,666,842 A * 9/1997 Komatsubara ..... B21B 37/74 72/200
(Continued)

FOREIGN PATENT DOCUMENTS

CN 1219977 6/1999
CN 1236824 12/1999
(Continued)

OTHER PUBLICATIONS

Machine translation of JP2-115319A, Apr. 1990.*
(Continued)

*Primary Examiner* — Xiaowei Su
(74) *Attorney, Agent, or Firm* — RatnerPrestia

(57) ABSTRACT

In a method for producing a grain-oriented electrical steel sheet by hot rolling a steel slab comprising C: 0.04-0.12 mass %, Si: 1.5-5.0 mass %, Mn: 0.01-1.0 mass %, sol. Al: 0.010-0.040 mass %, N: 0.004-0.02 mass %, one or two of S and Se: 0.005-0.05 mass % in total of S and Se, cold rolling, and subjecting to primary recrystallization annealing and further to final annealing, a content ratio of sol. Al to N in the steel slab (sol. Al/N) and a final thickness d (mm) satisfy an equation of 4d+1.52≤sol. Al/N≤4d+2.32, and the steel sheet in the heating process of the final annealing is held at a temperature of 775-875° C. for 40-200 hours and then heated in a temperature region of 875-1050° C. at a heating rate of 10-60° C./hr to preform secondary recrystallization and purification treatment, whereby an extremely-thin grain-oriented electrical steel sheet having a low iron loss and a small deviation in coil is produced.

12 Claims, 1 Drawing Sheet

(51) Int. Cl.

| | |
|---|---|
| ***C21D 1/26*** | (2006.01) |
| ***C22C 38/60*** | (2006.01) |
| ***H01F 1/16*** | (2006.01) |
| ***C21D 8/12*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/16*** | (2006.01) |
| ***C22C 38/34*** | (2006.01) |
| ***H01F 41/02*** | (2006.01) |

(52) U.S. Cl.

CPC ..... *C21D 8/1233* (2013.01); *C21D 8/1261* (2013.01); *C21D 8/1272* (2013.01); *C21D 9/46* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/16* (2013.01); *C22C 38/34* (2013.01); *C22C 38/60* (2013.01); *H01F 1/16* (2013.01); *H01F 41/02* (2013.01)

(56) References Cited

U.S. PATENT DOCUMENTS

| | | | | |
|---|---|---|---|---|
| 6,083,326 | A * | 7/2000 | Komatsubara ..... | C21D 8/1294 148/308 |
| 2002/0011278 | A1 | 1/2002 | Komatsubara | |
| 2012/0131982 | A1* | 5/2012 | Imamura ..... | C21D 8/12 72/362 |

FOREIGN PATENT DOCUMENTS

| | | | | |
|---|---|---|---|---|
| CN | 101454465 | | 6/2009 | |
| JP | 63105926 | | 5/1988 | |
| JP | 02115319 | | 4/1990 | |
| JP | 4002724 | | 1/1992 | |
| JP | 04341518 | | 11/1992 | |
| JP | 06025747 | | 2/1994 | |
| JP | 0717956 | | 3/1995 | |
| JP | 07042507 | | 5/1995 | |
| JP | 07186773 | | 7/1995 | |
| JP | 07188758 | | 7/1995 | |
| JP | 09316537 | | 12/1997 | |
| JP | 11199939 | | 7/1999 | |
| JP | 3357578 | | 12/2002 | |
| JP | 3357601 | | 12/2002 | |
| JP | 2009209428 | | 9/2009 | |
| JP | 2010280970 | | 12/2010 | |
| JP | 2012188733 | | 10/2012 | |
| JP | 2013047382 | | 3/2013 | |
| WO | WO 2011013858 | A1 * | 2/2011 | ..... C12D 8/12 |

OTHER PUBLICATIONS

Machine translation of JP63-105926A, May 1988.*
Machine translation of JP02-115319A, Apr. 1990.*
Extended European Search Report dated Feb. 16, 2016 in European Application No. 13876350.3-1362.
Chinese Office Action dated May 5, 2016 for Chinese Application No. 201380073829.8, with Concise Statement of Relevance.
Japanese Office Action dated Dec. 16, 2015 for Japanese Application No. 2012-166793.
International Search Report for International Application No. PCT/JP2013/055081 dated Jun. 4, 2013.
Korean Office Action for Korean Application No. 20157023294, dated Jun. 1, 2016 with Concise Statement of Relevance of Office Action.

* cited by examiner

METHOD FOR PRODUCING GRAIN-ORIENTED ELECTRICAL STEEL SHEET

CROSS REFERENCE TO RELATED APPLICATIONS

This is the U.S. National Phase application of PCT/JP2013/055081, filed Feb. 27, 2013, the disclosures of each of these applications being incorporated herein by reference in their entireties for all purposes.

FIELD OF THE INVENTION

This invention relates to a method for producing a grain-oriented electrical steel sheet mainly used in a core material for transformers, power generators and the like, and more particularly to a method for producing a grain-oriented electrical steel sheet with an extremely thin thickness of 0.15-0.23 mm and a low iron loss.

BACKGROUND OF THE INVENTION

Grain-oriented electrical steel sheets containing Si and having a crystal orientation highly aligned in {110}<001> orientation (Goss orientation) or {100}<001> orientation (Cube orientation) are excellent in the soft magnetic property, so that they are widely used as a core material for various electric instruments used in a commercial frequency region. The grain-oriented electrical steel sheet used in such an application is generally required to be low in the iron loss $W_{17/50}$ (W/kg) representing magnetic loss when it is magnetized to 1.7 T at a frequency of 50 Hz. Because, the efficiency of power generator or transformer can be largely improved by using a core material with a low $W_{17/50}$ value. Therefore, it is strongly demanded to develop materials having a low iron loss.

The iron loss of the electrical steel sheet is represented by a sum of hysteresis loss depending on crystal orientation, purity or the like and eddy current loss depending on sheet thickness, size of magnetic domain or the like. As a method of reducing the iron loss, therefore, there are known a method wherein an integration degree of crystal orientation is enhanced to increase a magnetic flux density and reduce hysteresis loss, a method wherein eddy current loss is reduced by increasing Si content for enhancing an electrical resistance, decreasing a thickness of a steel sheet or subdividing magnetic domain, and so on.

As to the method of increasing the magnetic flux density among these methods of reducing the iron loss, for example, Patent Documents 1 and 2 disclose that when Ni is added and Sb is added within a given range in response to the addition amount of Ni in the production method of the grain-oriented electrical steel sheet using AlN as an inhibitor, an extremely strong suppression force is obtained against the growth of primary recrystallized grains and hence it is attempted to improve primary recrystallized grain texture and refine secondary recrystallized grains and also an average in-plane angle deviated from {110}<001> orientation toward rolling direction can be made small to largely reduce the iron loss.

As the method of decreasing the sheet thickness, there are known a rolling method and a chemical polishing method. The method of decreasing the thickness by chemical polishing largely lowers the yield and is not suitable in the industrial-scale production. Therefore, the rolling method is exclusively used as the method of decreasing the sheet thickness. However, when the sheet thickness is decreased by rolling, there are problems that secondary recrystallization in final annealing becomes unstable and it is difficult to stably produce products having excellent magnetic properties.

As to such problems, For example, Patent Document 3 proposes that when a thin grain-oriented electrical steel sheet is produced by using AlN as a main inhibitor and performing final cold rolling under a strong rolling reduction, an excellent value of iron loss is obtained by composite addition of Sn and Se and further addition of Cu and/or Sb, and Patent Document 4 proposes that when Nb is added in the production method of a thin grain-oriented electrical steel sheet having a thickness of not more than 0.20 mm, fine dispersion of carbonitride is promoted to strengthen an inhibitor and improve magnetic properties. Further, Patent Document 5 proposes a method for producing a thin grain-oriented electrical steel sheet by single cold rolling wherein a thickness of a hot rolled sheet is made thinner and a coiling temperature is lowered and a pattern of final annealing is controlled properly, and Patent Document 6 proposes a method wherein a grain-oriented electrical steel sheet having a thickness of not more than 0.23 mm is produced by single cold rolling when a sheet thickness of a hot rolled coil is made to not more than 1.9 mm.

PATENT DOCUMENTS

Patent Document 1: Japanese Patent No. 3357601
Patent Document 2: Japanese Patent No. 3357578
Patent Document 3: JP-B-H07-017956
Patent Document 4: JP-A-H06-025747
Patent Document 5: JP-B-H07-042507
Patent Document 6: JP-A-H04-341518

SUMMARY OF THE INVENTION

In the method of reducing the iron loss of the grain-oriented electrical steel sheet, it is effective to apply the aforementioned conventional art to make the sheet thickness thinner by rolling and decrease eddy current loss. In extremely-thin grain-oriented electrical steel sheets having a sheet thickness of 0.15-0.23 mm after final cold rolling, however, even if the method disclosed in the conventional art is applied, there is still a problem that poor secondary recrystallization is caused in a part of the coil to lower the yield.

It is, therefore, an object of the invention to solve the above problems retained in the conventional art and to propose an advantageous method wherein secondary recrystallization is stably caused even in an extremely-thin grain-oriented electrical steel sheet having a sheet thickness of 0.15-0.23 mm to produce a grain-oriented electrical steel sheet having a uniform and extremely-low iron loss in a product coil.

In order to elucidate causes on unstable behavior of secondary recrystallization in grain-oriented electrical steel sheets having a thin thickness, the inventors have taken out a sample of a steel sheet on the way of secondary recrystallization annealing when the steel sheet after primary recrystallization annealing is subjected to final annealing and then investigated precipitation state of inhibitor and growth state of crystal grains therein. As a result, it has been identified that the inhibitor is coarsened in the heating process of the final annealing to lower a force of suppressing crystal grain growth, and the inhibitor ingredient is oxidized and disappeared by surface oxidation of the steel sheet in a temperature region of not lower than 875° C. to cause coarsening of grains in surface layer and this tendency becomes particularly remarkable in a region of not lower than 975° C., and the decrease of force suppressing crystal grain growth due to the coarsening of the inhibitor and the progression of coarsening grains in the surface layer are main causes of poor secondary recrystallization in the extremely-thin grain-oriented electrical steel sheet having a sheet thickness of 0.15-0.23 mm.

The inventors have made further studies on a method for sufficiently ensuring a driving force required for secondary recrystallization under a thinking that secondary recrystallization is stably caused over a full length of a coil by suppressing the growth of primary recrystallized grains. As a result, it has been found out that a content ratio of sol. Al to N in a steel slab as a raw material (sol. Al/N) is controlled to a proper range in accordance with a thickness of a product sheet or a final thickness d after cold rolling to make a grain size of a central layer in the thickness direction of the steel sheet to a size suitable for secondary recrystallization, while the steel sheet before secondary recrystallization is held at a given temperature for a given time in the heating process of final annealing to uniformize a temperature in a coil and then rapid heating is performed at a heating rate of 10-60° C./hr to adjust a grain size of a surface layer in the steel sheet to a proper range, whereby secondary recrystallization can be stably caused over a full length of the coil to provide a grain-oriented electrical steel sheet having a uniform and very low iron loss over the full length of the coil.

The invention is made based on the above knowledge and includes a method for producing a grain-oriented electrical steel sheet comprising a series of steps of heating a steel slab having a chemical composition comprising C: 0.04-0.12 mass %, Si: 1.5-5.0 mass %, Mn: 0.01-1.0 mass %, sol. Al: 0.010-0.040 mass %, N: 0.004-0.02 mass %, one or two of S and Se: 0.005-0.05 mass % in total and the remainder being Fe and inevitable impurities to not lower than 1250° C., hot rolling to obtain a hot rolled sheet having a thickness of not less than 1.8 mm, subjecting the hot rolled sheet to a single cold rolling or two or more cold rollings with an intermediate annealing therebetween to obtain a cold rolled sheet having a final thickness of 0.15-0.23 mm, and subjecting the cold rolled sheet to primary recrystallization annealing and further to final annealing, characterized in that a content ratio of sol. Al to N in the steel slab (sol. Al/N) and a final thickness d (mm) satisfy the following equation (1):

$$4d+1.52 \leq \text{sol. Al/N} \leq 4d+2.32 \quad (1)$$

and the steel sheet in the heating process of the final annealing is held at a temperature of 775-875° C. for 40-200 hours and then heated in a temperature region of 875-1050° C. at a heating rate of 10-60° C./hr.

In the production method of the grain-oriented electrical steel sheet according to an embodiment of the invention, the steel slab is characterized by containing one or more selected from Ni: 0.1-1.0 mass %, Cu: 0.02-1.0 mass % and Sb: 0.01-0.10 mass % in addition to the above ingredients.

Also, the steel slab in the production method of the grain-oriented electrical steel sheet according to an embodiment of the invention is characterized by containing 0.002-1.0 mass % in total of one or more selected from Ge, Bi, V, Nb, Te, Cr, Sn and Mo in addition to the above ingredients.

The production method of the grain-oriented electrical steel sheet according to an embodiment of the invention is characterized in that a region of 200-700° C. in the heating process of the primary recrystallization annealing is heated at a heating rate of not less than 50° C./s, while any temperature between 250-600° C. is held for 1-10 seconds.

Also, the production method of the grain-oriented electrical steel sheet according to an embodiment of the invention is characterized in that the steel sheet is subjected at any stage after the cold rolling to a magnetic domain subdividing treatment by forming grooves on the steel sheet surface in a direction intersecting with the rolling direction.

Furthermore, the production method of the grain-oriented electrical steel sheet according to an embodiment of the invention is characterized in that the steel sheet is subjected to a magnetic domain subdividing treatment by continuously or discontinuously irradiating electron beams or laser to a steel sheet surface provided with an insulation coating in a direction intersecting with the rolling direction.

According to the invention, the decrease in the suppressing force of the inhibitor in the secondary recrystallization annealing is preferably prevented to properly adjust the grain size of the central layer in the thickness direction by controlling the value of ratio (sol. Al/N) in the steel material (slab) in accordance with a product sheet thickness (final thickness), and further the steel sheet before the secondary recrystallization is held at a given temperature for a given time during the heating of the final annealing to uniformize the temperature in coil and then heated to a secondary recrystallization temperature rapidly to suppress the coarsening of grains in the surface layer of the steel sheet, whereby the secondary recrystallization can be stably generated over the full length of the coil, so that it is possible to produce a grain-oriented electrical steel sheet having an excellent iron loss property with a higher yield.

DETAILED DESCRIPTION OF EMBODIMENTS OF THE INVENTION

Figure 1:
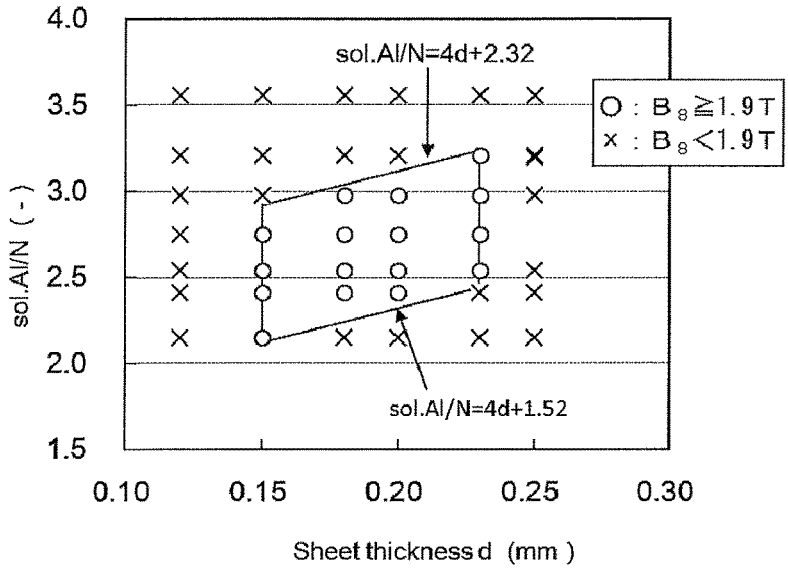
FIG. 1 is a graph showing a range between a final thickness d and a ratio (sol. Al/N) for providing a magnetic flux density $B_8$ of not less than 1.90 T.

Experiments leading to the development of the invention will be first described below.

Experiment 1

Each of seven steel slabs having a chemical composition containing C: 0.07 mass %, Si: 3.4 mass %, Mn: 0.07 mass %, Se: 0.015 mass %, Ni: 0.3 mass %, Cu: 0.03 mass % and Sb: 0.04 mass % and having a content ratio of sol. Al to N (sol. Al/N) varied within a range of 2.10-3.56 as shown in Table 1 is hot rolled to obtain a hot rolled coil of 2.4 mm in thickness, which is subjected to a hot band annealing at 900° C. for 40 seconds, pickled and subjected to a first cold rolling to a sheet thickness of 1.5 mm and an intermediate annealing at 1150° C. for 80 seconds, warm rolled at a temperature of 170° C. to obtain a cold rolled coil having a sheet thickness within a range of 0.12-0.25 mm. The coil is degreased and then subjected to primary recrystallization annealing combined with decarburization at 850° C. in a wet hydrogen atmosphere of 60 vol % $H_2$-40 vol % $N_2$ for 2 minutes.

The, the steel sheet after the primary recrystallization is coated on its surface with an annealing separator composed mainly of MgO, dried, heated to 850° C. in $N_2$ atmosphere at a heating rate of 20° C./hr, held at 850° C. for 50 hours, heated from 850° C. to 1150° C. in a mixed atmosphere of 25 vol % $N_2$-75 vol % $H_2$ and from 1150° C. to 1200° C. in $H_2$ atmosphere at a heating rate of 20° C./hr, soaked at 1200° C. in $H_2$ atmosphere for 10 hours and thereafter subjected to final annealing combined with secondary recrystallization annealing and purification treatment by cooling in $N_2$ atmosphere in a region of not higher than 800° C. After the unreacted annealing separator is removed from the steel sheet surface after the final annealing, an insulation coating composed mainly of aluminum phosphate and colloidal silica is applied to obtain a product coil.

the secondary recrystallization is generated over the full length of the coil to improve the magnetic properties.

Experiment 2

A steel slab containing C: 0.07 mass %, Si: 3.4 mass %, Mn: 0.07 mass %, sol. Al: 0.020 mass %, N: 0.007 mass %, Se: 0.015 mass %, Ni: 0.3 mass %, Cu: 0.03 mass % and Sb: 0.04 mass % is hot rolled to obtain a hot rolled coil of 2.4 mm in thickness, which is subjected to a hot band annealing at 900° C. for 40 seconds, pickled and subjected to a first cold rolling to a sheet thickness of 1.5 mm and an intermediate annealing at 1150° C. for 80 seconds, warm rolled at a temperature of 170° C. to obtain a cold rolled coil having a final thickness of 0.20 mm, degreased and thereafter subjected to primary recrystallization annealing combined with decarburization at 850° C. in a wet hydrogen atmosphere of 60 vol % $H_2$-40 vol % $N_2$ for 2 minutes.

TABLE 1

| | Chemical composition (mass %) | | | | | | | Guarantee value of $B_8$ in coil (T) | | | |
|---|---|---|---|---|---|---|---|---|---|---|---|
| | | | | | | | | d = | d = | d = | d = |
| No | C | Si | Mn | Se | sol. Al | N | sol. Al/N | 0.12 mm | 0.15 mm | 0.18 mm | 0.20 mm |
| 1 | 0.08 | 3.4 | 0.07 | 0.015 | 0.0168 | 0.0078 | 2.15 | 1.80 | 1.90 | 1.83 | 1.85 |
| 2 | 0.07 | 3.4 | 0.07 | 0.016 | 0.0181 | 0.0075 | 2.41 | 1.81 | 1.90 | 1.90 | 1.91 |
| 3 | 0.08 | 3.4 | 0.07 | 0.015 | 0.0183 | 0.0072 | 2.54 | 1.79 | 1.92 | 1.91 | 1.91 |
| 4 | 0.08 | 3.4 | 0.07 | 0.015 | 0.0201 | 0.0073 | 2.75 | 1.78 | 1.90 | 1.91 | 1.92 |
| 5 | 0.07 | 3.4 | 0.07 | 0.015 | 0.0218 | 0.0073 | 2.98 | 1.77 | 1.88 | 1.92 | 1.92 |
| 6 | 0.09 | 3.4 | 0.07 | 0.015 | 0.0254 | 0.0079 | 3.21 | 1.72 | 1.79 | 1.86 | 1.88 |
| 7 | 0.07 | 3.4 | 0.07 | 0.015 | 0.0288 | 0.0081 | 3.56 | 1.60 | 1.62 | 1.65 | 1.69 |

| | Guarantee value of $B_8$ in coil (T) | | Good value of $B_8$ in coil (T) | | | | | |
|---|---|---|---|---|---|---|---|---|
| No | d = 0.23 mm | d = 0.25 mm | d = 0.12 mm | d = 0.15 mm | d = 0.18 mm | d = 0.20 mm | d = 0.23 mm | d = 0.25 mm |
| 1 | 1.86 | 1.86 | 1.88 | 1.90 | 1.87 | 1.88 | 1.88 | 1.89 |
| 2 | 1.87 | 1.87 | 1.90 | 1.91 | 1.91 | 1.92 | 1.89 | 1.89 |
| 3 | 1.90 | 1.87 | 1.90 | 1.93 | 1.92 | 1.93 | 1.93 | 1.90 |
| 4 | 1.91 | 1.87 | 1.89 | 1.92 | 1.92 | 1.93 | 1.94 | 1.91 |
| 5 | 1.91 | 1.87 | 1.88 | 1.90 | 1.93 | 1.94 | 1.94 | 1.91 |
| 6 | 1.92 | 1.88 | 1.81 | 1.83 | 1.88 | 1.88 | 1.94 | 1.93 |
| 7 | 1.69 | 1.70 | 1.66 | 1.69 | 1.69 | 1.68 | 1.75 | 1.79 |

Test specimens for magnetic measurement are taken out at 5 places of 0 m, 1000 m, 2000 m, 3000 m and 4000 m in its longitudinal direction from the product coil having a full length of about 4000 m thus obtained to measure a magnetic flux density $B_8$ at a magnetization force of 800 A/m. The results are also shown in Table 1 wherein a lowest value of the magnetic flux density in the coil is a guarantee value in coil and a highest value is a good value in coil. In FIG. 1 is shown a range of a sheet thickness d and a ratio (sol. Al/N) for providing a magnetic flux density $B_8$ of not less than 1.90 T. Here, the magnetic flux density $B_8$ is an indication effective for properly judging the generation of secondary recrystallization, in which the higher guarantee value of $B_8$ in coil means that the secondary recrystallization is uniformly generated in the coil.

As seen from these results, when the value of ratio (sol. Al/N) in the raw steel material (slab) is controlled to a proper range in accordance with the sheet thickness (final thickness) in the secondary recrystallization annealing and is concretely controlled to satisfy the following equation (1):

$$4d+1.52 \leq \text{sol. Al/N} \leq 4d+2.32 \quad (1),$$

Next, the steel sheet after the primary recrystallization is coated with an annealing separator composed mainly of MgO, dried, heated to 850° C. at a heating rate of 20° C./hr in $N_2$ atmosphere, and thereafter heated to 1200° C. in a mixed atmosphere of 25 vol % $N_2$-75 vol % $H_2$ in a region of 850-1150° C. and in $H_2$ atmosphere in a region of 1150-1200° C. according to heating patterns A-G of varying a heating rate in a region of 850-1050° C. with or without holding at 850° C. as shown in Table 2, soaked at 1200° C. in $H_2$ atmosphere for 10 hours and thereafter subjected to final annealing combined with secondary recrystallization annealing and purification treatment by cooling in a region of not higher than 800° C. in $N_2$ atmosphere. Then, the unreacted annealing separator is removed off from the surface of the steel sheet after the final annealing, and subsequently an insulation coating composed mainly of aluminum phosphate and colloidal silica is formed to obtain a product coil.

TABLE 2

| Heating pattern | Heating conditions in final annealing: Presence or absence of holding treatment at 850° C. × 50 hr | Heating rate from 850 to 1050° C. (° C./hr) | Guarantee value in coil: Magnetic flux density $B_8$ (T) | Guarantee value in coil: Iron loss $W_{17/50}$ (W/kg) | Good value in coil: Magnetic flux density $B_8$ (T) | Good value in coil: Iron loss $W_{17/50}$ (W/kg) | Remarks |
|---|---|---|---|---|---|---|---|
| A | Absence | 20 | 1.59 | 1.677 | 1.72 | 1.372 | Comparative Example |
| B | Presence | 5 | 1.71 | 1.338 | 1.92 | 0.875 | Comparative Example |
| C | Presence | 10 | 1.90 | 0.919 | 1.92 | 0.861 | Invention Example |
| D | Presence | 20 | 1.92 | 0.867 | 1.93 | 0.846 | Invention Example |
| E | Presence | 30 | 1.91 | 0.873 | 1.92 | 0.859 | Invention Example |
| F | Presence | 50 | 1.91 | 0.889 | 1.92 | 0.872 | Invention Example |
| G | Presence | 100 | 1.89 | 0.976 | 1.90 | 0.924 | Comparative Example |

Figure 2:
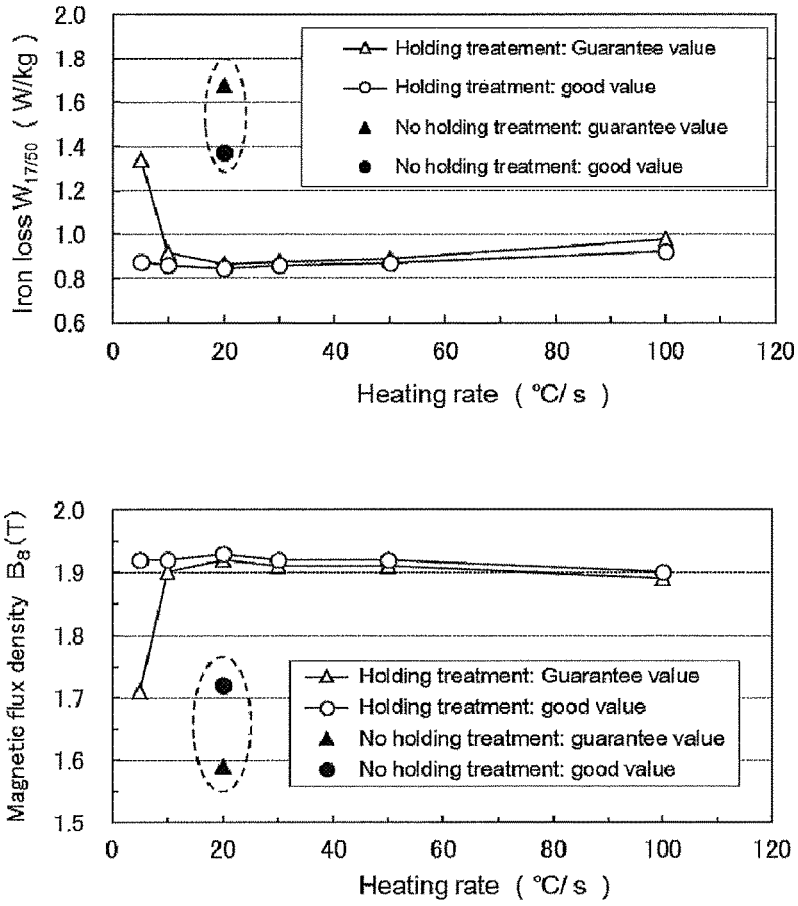
FIG. 2 is a graph showing a relation between a heating rate from 850° C. to 1050° C. in final annealing and a guarantee value of iron loss $W_{17/50}$ in a coil.

Test specimens for magnetic measurement are taken out at 5 places of 0 m, 1000 m, 2000 m, 3000 m and 4000 m in its longitudinal direction from the product coil having a full length of about 4000 m thus obtained to measure a magnetic flux density $B_8$ at a magnetization force of 800 A/m and an iron loss value $W_{17/50}$ per mass at an amplitude of magnetic flux density of 1.7 T and 50 Hz, in which worst values of $B_8$ and $W_{17/50}$ in the coil are guarantee values in coil and best values of $B_8$ and $W_{17/50}$ in the coil are good values in coil. The results are also shown in Table 2. Furthermore, a relation among heating rate in a region of 850-1050° C., magnetic flux density $B_8$ and guarantee value in coil and good value in coil of iron loss $W_{17/50}$ is shown in FIG. 2.

As seen from these results, the heating pattern A of performing no holding at 850° C. for 50 hours on the way of heating in the final annealing and the heating pattern B of heating at a low heating rate of 5° C./hr in a region of 850-1050° C. are bad in the guarantee value in coil because secondary recrystallization is not uniformly caused in the coil, while in the heating patterns C-G of rapidly heating at a heating rate of not less than 10° C./hr after the holding at 850° C., secondary recrystallization is generated stably to improve the magnetic properties over the full length of the coil. However, the magnetic properties are slightly deteriorated at a heating rate of 100° C./hr (Heating pattern G).

The invention is made based on the above knowledge.

The chemical composition of the raw steel material in the grain-oriented electrical steel sheet according to embodiments of the invention will be described below.

C: 0.04-0.12 Mass %

C is an element useful for making the texture uniform and fine during hot rolling and cold rolling and developing Goss orientation, and is necessary to be included in an amount of at least 0.04 mass %. However, when it is added in an amount exceeding 0.12 mass %, decarburization is poor during decarburization annealing and there is a risk of deteriorating the magnetic properties. Therefore, C content is a range of 0.04-0.12 mass %. Preferably, it is a range of 0.05-0.10 mass %.

Si: 1.5-5.0 Mass %

Si is an element effective for enhancing a specific resistance of a steel sheet to reduce an iron loss. In the invention, it is preferably included in an amount of not less than 1.5 mass % from a viewpoint of ensuring good magnetic properties. While when it is added in an amount exceeding 5.0 mass %, cold workability is considerably deteriorated. Therefore, Si content is added in a range of 1.5-5.0 mass %. Preferably, it is added in a range of 2.0-4.0 mass %.

Mn: 0.01-1.0 Mass %

Mn is an element effective for improving hot workability and preventing generation of surface flaw in the hot rolling and is necessary to be included in an amount of not less than 0.01 mass % for obtaining such an effect. However, when it is added in an amount of exceeding 1.0 mass %, the magnetic flux density is lowered. Therefore, Mn content is added in a range of 0.01-1.0 mass %. Preferably, it is added in a range of 0.04-0.2 mass %.

Sol. Al: 0.010-0.040 Mass %

Al is an essential element for forming AlN as an inhibitor. When it is less than 0.010 mass % as sol. Al, the amount of AlN precipitated in the heating process during hot rolling or hot band annealing is lacking and hence the effect of the inhibitor cannot be obtained. While when it is added in an amount exceeding 0.040 mass %, the inhibitor precipitated is coarsened and rather the inhibiting force is lowered. In order to sufficiently obtain the inhibitor effect of AlN, therefore, Al content is necessary to be in a range of 0.010-0.040 mass % as sol. Al. Preferably, it is in a range of 0.02-0.03 mass %.

N: 0.004-0.02 Mass %

N is an essential element for forming AlN as an inhibitor like Al. However, N may be added by performing nitriding treatment in the cold rolling step, so that it is sufficient to be included in an amount of not less than 0.004 mass % at the slab stage. If the nitriding treatment is not performed in the cold rolling step, it is necessary to be included in an amount of not less than 0.005 mass %. On the other hand, when it is added in an amount exceeding 0.02 mass %, there is a risk of causing blister in the hot rolling. Therefore, N content is in a range of 0.004-0.02 mass %. Preferably, it is in a range of 0.005-0.01 mass %.

Sol. Al/N

In preferred embodiments of the invention, it is important that a ratio of sol. Al content to N content (mass %) in the raw steel material is properly adjusted in accordance with a final sheet thickness in the cold rolling (product sheet thickness) d (mm), and concretely it is controlled so as to satisfy a relation of the following equation (1):

$$4d+1.52 \leq \text{sol. Al/N} \leq 4d+2.32 \quad (1)$$

When the value of sol. Al/N is large as shown in FIG. 1, the inhibiting force of AlN as an inhibitor is not sufficient and the coarsening of crystal grains in the surface layer and central layer of the steel sheet is caused. While when the value of sol. Al/N is small, grains having a large deviation from Goss orientation are also subjected to secondary recrystallization, and hence the magnetic flux density after the secondary recrystallization is lowered and the iron loss is increased. Preferably, the left side of the equation (1) is 4d+1.81, and the right side thereof is 4d+2.32.

Moreover, the value of sol. Al/N is properly adjusted in response to the final sheet thickness d (mm) and the sol. Al content in the raw steel material, so that the N content may be adjusted by performing the nitriding treatment before the secondary recrystallization.

S and Se: 0.005-0.05 Mass % in Total

S and Se are essential elements required for forming $Cu_2S$, $Cu_2Se$ or the like and finely precipitating together with AlN. In embodiments of the invention, they are necessary to be included in an amount of not less than 0.005 mass % alone or in total for achieving such a purpose. However, when they are added in an amount exceeding 0.05 mass %, the coarsening of precipitates is caused. Therefore, S and Se contents are in a range of 0.005-0.05 mass % alone or in total. Preferably, it is in a range of 0.01-0.03 mass %.

The grain-oriented electrical steel sheet according to embodiments of the invention may further contain one or two selected from Ni, Cu and Sb in addition to the above ingredients.

Ni: 0.10-1.0 Mass %

Ni is an element of suppressing the coarsening of the inhibitor by segregating into grain boundaries to promote co-segregation effect with another segregating element such as Sb or the like, so that it is included in an amount of not less than 0.10 mass %. However, when it is added in an amount exceeding 1.0 mass %, the texture after the primary recrystallization annealing is deteriorated to cause the deterioration of the magnetic properties. Therefore, Ni content is in a range of 0.10-1.0 mass %. Preferably, it is in a range of 0.10-0.50 mass %.

Cu: 0.02-1.0 Mass %

Cu is an element constituting $Cu_2S$ or $Cu_2Se$ and is advantageous as compared to MnS or MnSe because the lowering of the inhibiting force during final annealing is gentle. Furthermore, when $Cu_2S$ or $Cu_2Se$ is segregated together with Ni or Sb, it is difficult to lower the inhibiting force of the inhibitor. In the invention, therefore, Cu may be added in an amount of not less than 0.02 mass %. However, when it is included in an amount exceeding 1.0 mass %, the coarsening of the inhibitor is caused. Therefore, Cu content is in a range of 0.02-1.0 mass %. Preferably, it is in a range of 0.04-0.5 mass %.

Sb: 0.01-0.10 Mass %

Sb is an element required for segregating onto surfaces of AlN, $Cu_2S$, $Cu_2Se$, MnS and MnSe as the precipitated inhibitor to inhibit the coarsening of the inhibitor. Such an effect is obtained by the addition of not less than 0.01 mass %. However, when it is added in an amount exceeding 0.10 mass %, decarburization reaction is obstructed to bring about the deterioration of the magnetic properties. Therefore, Sb content is in a range of 0.01-0.10 mass %. Preferably, it is in a range of 0.02-0.05 mass %.

Also, the grain-oriented electrical steel sheet according to the invention may further contain 0.002-1.0 mass % in total of one or more selected from Ge, Bi, V, Nb, Te, Cr, Sn and Mo as an auxiliary ingredient for the inhibitor in addition to the above ingredients.

These elements fulfil an auxiliary function of forming precipitates and segregating onto crystal grain boundaries or precipitate surfaces to strengthen the inhibiting force. In order to obtain such an action, one or more of these elements are necessary to be included in an amount of not less than 0.002 mass % in total. However, when they are added in an amount exceeding 1.0 mass %, there is a risk of causing embrittlement of steel or poor decarburization. Therefore, these elements are preferable to be included in an amount of 0.002-1.0 mass % in total.

The production method of the grin-oriented electrical steel sheet according to embodiments of the invention will be described below.

The production method of the grain-oriented electrical steel sheet according to the invention comprises a series of steps of reheating a steel slab adjusted to the above chemical composition, hot rolling, hot band annealing as required, subjecting to a single cold rolling or two or more cold rollings including an intermediate annealing therebetween, primary recrystallization annealing and subjecting to final annealing combined with secondary recrystallization annealing and purification treatment.

The steel slab can be usually produced under the well-known production conditions without particularly limiting the manufacturing method as long as it satisfies the chemical composition defined in the invention.

Then, the steel slab is reheated to a temperature of not lower than 1250° C. and subjected to hot rolling. When the reheating temperature is lower than 1250° C., the added elements are not dissolved into steel. As the reheating method can be used a well-known method with a gas furnace, an induction heating furnace, an electric furnace or the like. Further, conditions of the hot rolling may be the conventionally known conditions and are not particularly limited.

The slab after the reheating is hot rolled to obtain a hot rolled sheet having a sheet thickness of not less than 1.8 mm (hot rolled coil). Here, the reason why the thickness of the hot rolled sheet is limited to not less than 1.8 mm is based on the fact that the rolling time is shortened to decrease temperature difference of the hot rolled coil in the rolling direction. Moreover, the conditions of the hot rolling may be determined according to the usual manner and are not particularly limited.

Thereafter, the hot rolled sheet obtained by hot rolling (hot rolled coil) is subjected to a hot band annealing as required, pickled and subjected to a single cold rolling or two or more cold rollings including an intermediate annealing therebetween to obtain a cold rolled sheet of a final thickness (cold rolled coil).

The hot band annealing and the intermediate annealing are preferable to be performed at a temperature of not lower than 800° C. in order to utilize strain introduced in the hot rolling or cold rolling for recrystallization. It is preferable to perform rapid cooling at a given cooling rate and to increase a dissolution amount of C in steel during annealing, since nucleus forming frequency of secondary recrystallization is thereby increased. Also, the holding within a given temperature range after the rapid cooling is more preferable because fine carbide is precipitated in steel to enhance the above effect. In the cold rolling may be applied aging between passes or warm rolling as a matter of course.

Moreover, the final sheet thickness (product sheet thickness) of the grain-oriented electrical steel sheet according to the invention is preferably a range of 0.15-0.23 mm. When the sheet thickness exceeds 0.23 mm, the driving force of secondary recrystallization becomes excessive and dispersion of secondary recrystallized grains from Goss orientation is increased. While when it is less than 0.15 mm, the secondary recrystallization becomes unstable and the ratio of the insulation coating is relatively increased, and hence not only the magnetic flux density is lowered but also it is difficult to produce the sheet by rolling.

Thereafter, the cold rolled sheet having a final thickness is degreased, subjected to primary recrystallization annealing combined with decarburization annealing, coated on its surface with an annealing separator, wound into a coil and then subjected to final annealing for generation of secondary recrystallization and purification treatment.

In the primary recrystallization annealing, it is preferable that a region of 200-700° C. in the heating process is heated at a heating rate of not less than 50° C./s and a holding treatment is performed at any temperature of 250-600° C. for 1-10 seconds. By performing such rapid heating and holding treatment are obtained more refined crystal grains after secondary recrystallization, whereby grain-oriented electrical steel sheets having a low iron loss and a small deviation of iron loss value can be obtained. Moreover, the temperature change in the holding treatment may be within ±50° C., for which no problem is caused.

In order to adjust the value of ratio (sol. Al/N) to a proper range, nitriding treatment may be performed during the primary recrystallization annealing as requested, or the nitriding treatment may be added after the cold rolling and before the final annealing separately from the primary recrystallization annealing.

The cold rolled sheet may be subjected to magnetic domain subdividing treatment forming grooves on the steel sheet surface by etching before the primary recrystallization annealing for reducing iron loss of a product sheet. Also, the cold rolled sheet may be subjected to a well-known magnetic domain subdividing treatment such as a local dotted heat treatment forming fine crystal grains or a chemical treatment before the secondary recrystallization.

As the annealing separator applied onto the steel sheet surface can be used publicly known ones. It is preferable to use them properly in response to the formation or no formation of forsteritic film on the steel sheet surface. For example, when the film is formed on the surface, it is preferable to use an annealing separator composed mainly of MgO, while when the steel sheet surface is made to a mirror state, it is preferable to use an $Al_2O_3$-based annealing separator or the like not forming the film.

The final annealing is the most important step in the production method according to embodiments of the invention. In general, the final annealing is combined with secondary recrystallization annealing and purification annealing and is performed at a temperature of about 1200° C. at maximum. In the production method of the grain-oriented electrical steel sheet according to embodiments of the invention, however, it is necessary to hold the sheet at a temperature region of 775-875° C. before secondary recrystallization for 40-200 hours in the heating process of the final annealing. The reason is as follows.

Generally, the secondary recrystallization occurs at a temperature of about 1000° C. At a temperature region exceeding 875° C., oxidation of the inhibitor ingredients is caused to coarsen primary recrystallized grains in the surface layer of the steel sheet. The coarsening of the primary recrystallized grains in the surface layer results in the cause of poor secondary recrystallization in the grain-oriented electrical steel sheets having a thin thickness.

The inventors have made various studies for solving such a problem and found out that the coarsening of the primary recrystallized grains in the surface layer is suppressed by holding the steel sheet before the secondary recrystallization at a temperature region of 775-875° C. for 40-200 hours. When the holding time is less than 40 hours, the primary recrystallized grains in the surface layer are coarsened to cause poor secondary recrystallization and deteriorate the magnetic properties. While when the holding time exceeds 200 hours, the primary recrystallized grains are coarsened wholly and grains other than Goss orientation are also coarsened, and hence it is difficult to cause the secondary recrystallization and the magnetic properties are also deteriorated. The preferable holding time in the region of 775-875° C. is in a range of 45-100 hours.

Moreover, the holding before the secondary recrystallization may be performed by holding at a specified temperature in a region of 775-875° C. for 40-200 hours or by heating the sheet from 775 to 875° C. for 40-200 hours.

The reason why the coarsening of the primary recrystallized grains in the surface layer is suppressed by holding at a temperature region of 775-875° C. for 40-200 hours is considered as follows.

In the production of the grain-oriented electrical steel sheet using AlN as an inhibitor, AlN is decomposed at a temperature of not lower than about 920° C. to cause the coarsening of the, primary recrystallized grains in the surface layer. In order to suppress the decomposition of AlN before the start of the secondary recrystallization, it is necessary to rapidly heat the sheet to a secondary recrystallization temperature region. In the coil annealing, however, since the heating rate at an initial heating stage becomes gentle, the decomposition of AlN cannot be suppressed and the coarsening of the primary recrystallized grains in the surface layer is caused. To this end, when the sheet is held at a given temperature for a given time before the heating to a temperature causing recrystallization, the temperature distribution in the coil becomes uniform and the heating rate at a temperature region decomposing AlN becomes faster, and hence the coarsening of the primary recrystallized grains in the surface layer can be suppressed before the secondary recrystallization.

The heating rate from 875° C. to 1050° C. following the holding at the temperature region of 775-875° C. is not less than 10° C./hr from a viewpoint of suppressing the coarsening of the primary recrystallized grains in the surface layer. Preferably, it is not less than 20° C./hr. When the heating rate is made too high, there is a risk of lowering sharpness of secondary recrystallized grains to Goss orientation to deteriorate the magnetic properties, so that the upper limit is 60° C./hr. Preferably, it is not more than 50° C./hr.

Also, the heating rate from 1050° C. to the highest temperature is preferable to be not less than 5° C./hr from a viewpoint of economic efficiency, while it is preferable to be not more than 100° C./hr from a viewpoint of uniformizing the temperature inside the coil.

If the above holding is performed sufficiently, there is a risk of coarsening MnS or MnSe other than AlN as an inhibitor to lower the inhibiting force. In the invention, therefore, it is preferable to suppress the coarsening of the inhibitor by using $Cu_2S$ or $Cu_2Se$ hardly lowering the inhibiting force as an inhibitor and adding Sb to segregate Sb onto the inhibitor surface of precipitated $Cu_2S$ or $Cu_2Se$. Further, the segregation of Sb is promoted by adding Ni, whereby the inhibiting force of $Cu_2S$ or $Cu_2Se$ is more strengthened, so that it is possible to maintain the inhibiting force of the inhibitor at a high level.

As an atmosphere gas in the final annealing is used $N_2$, $H_2$, Ar or a mixed gas thereof. In general, $N_2$ is used in the heating process at a temperature of not higher than 850° C. and the cooling process, while $H_2$ or a mixed gas of $H_2$ and $N_2$ or $H_2$ and Ar is used at a temperature exceeding the above value.

After the unreacted annealing separator is removed off from the surface of the steel sheet after the final annealing, an insulation coating liquid is applied and baked on the steel sheet surface as requested or flattening annealing is performed to obtain a product sheet. As the insulation coating, a tension film is preferably used for reducing the iron loss. Also, the steel sheet after the final annealing may be subjected to a well-known magnetic domain subdividing treatment by continuously or discontinuously irradiating electron beams or laser beam or applying a linear strain by means of a roll with protrusions for reducing the iron loss. Moreover, when forsterite film is not formed on the steel sheet surface in the final annealing, the steel sheet surface is subjected to a mirroring treatment or an orientation selecting treatment of grains or the like is performed by electrolysis with NaCl or the like and thereafter a tension film is applied, whereby a product sheet may be produced.

Example 1

A steel slab having a chemical composition A-Q shown in Table 3 is hot rolled according to the usual manner to obtain a hot rolled coil of 2.4 mm in thickness, which is subjected to a hot band annealing at 900° C. for 40 seconds, pickled, subjected to primary cold rolling to a sheet thickness of 1.5 mm and further to an intermediate annealing at 1150° C. for 80 seconds, and warm rolled at a temperature of 170° C. to obtain a cold rolled coil having a final sheet thickness of 0.17 mm. Then, the cold rolled coil is degreased and subjected to primary recrystallization annealing combined with decarburization at 850° C. in a wet hydrogen atmosphere of 60 vol % $H_2$-40 vol % $N_2$ for 2 minutes. Thereafter, the steel sheet is coated on its surface with an annealing separator composed mainly of MgO, dried and subjected to final annealing by heating to 850° C. in $N_2$ atmosphere at a heating rate of 40° C./hr, holding at 850° C. for 50 hours, heating from 850° C. to 1150° C. in an atmosphere of 100 vol % $N_2$ and from 1150° C. to 1200° C. in $H_2$ atmosphere at a heating rate of 20° C./hr, soaking at 1200° C. in $H_2$ atmosphere for 10 hours and then cooling in a region of not higher than 800° C. in $N_2$ atmosphere. After the unreacted annealing separator is removed off from the steel sheet surface subjected to the final annealing, an insulation coating composed mainly of magnesium phosphate and colloidal silica is formed to obtain a product coil.

TABLE 3

| | Chemical component (mass %) | | | | | | | | | | | | Iron loss $W_{17/50}$ (W/kg) | | |
|---|---|---|---|---|---|---|---|---|---|---|---|---|---|---|---|
| Symbol of steel | C | Si | Mn | sol. Al | N | Se | S | Ni | Cu | Sb | Ge, Bi, V, Nb, Te, Cr, Sn, Mo* | sol. Al/N | Guarantee value in coil | Good value in coil | Remarks |
| A | 0.07 | 3.40 | 0.070 | 0.0225 | 0.0078 | 0.015 | 0.0001 | 0.30 | 0.030 | 0.04 | — | 2.88 | 0.821 | 0.789 | Invention Example |
| B | 0.075 | 3.24 | 0.065 | 0.0205 | 0.0074 | 0.015 | 0.0001 | — | 0.030 | 0.05 | — | 2.77 | 0.861 | 0.801 | Invention Example |
| C | 0.08 | 3.55 | 0.060 | 0.0207 | 0.0078 | 0.015 | 0.0001 | 0.30 | — | 0.05 | — | 2.65 | 0.863 | 0.832 | Invention Example |
| D | 0.075 | 3.40 | 0.064 | 0.0208 | 0.0072 | 0.017 | 0.0001 | 0.30 | 0.030 | — | — | 2.89 | 0.866 | 0.841 | Invention Example |
| E | 0.08 | 3.35 | 0.061 | 0.0224 | 0.0081 | 0.015 | 0.0002 | 0.30 | 0.030 | 0.05 | Nb: 0.02 | 2.77 | 0.842 | 0.788 | Invention Example |
| F | 0.09 | 3.25 | 0.071 | 0.0224 | 0.0079 | 0.015 | 0.0002 | — | — | — | Ge: 0.018 | 2.84 | 0.880 | 0.814 | Invention Example |
| G | 0.085 | 3.30 | 0.065 | 0.0217 | 0.0078 | 0.015 | 0.0002 | — | — | — | Bi: 0.018 | 2.78 | 0.901 | 0.844 | Invention Example |
| H | 0.07 | 3.45 | 0.067 | 0.0215 | 0.0078 | 0.015 | 0.0002 | — | — | — | V: 0.02 | 2.75 | 0.898 | 0.871 | Invention Example |
| I | 0.075 | 3.40 | 0.063 | 0.0214 | 0.0076 | 0.016 | 0.0002 | — | — | — | Nb: 0.02, Mo: 0.02 | 2.82 | 0.872 | 0.815 | Invention Example |
| J | 0.09 | 3.40 | 0.071 | 0.0208 | 0.0078 | 0.015 | 0.0002 | — | — | — | Te: 0.015 | 2.67 | 0.902 | 0.851 | Invention Example |
| K | 0.08 | 3.30 | 0.065 | 0.0216 | 0.0079 | 0.015 | 0.0002 | — | — | — | Cr: 0.05 | 2.73 | 0.907 | 0.843 | Invention Example |
| L | 0.08 | 3.45 | 0.064 | 0.0212 | 0.0077 | 0.015 | 0.0002 | — | — | — | Sn: 0.05 | 2.75 | 0.933 | 0.840 | Invention Example |
| M | 0.09 | 3.40 | 0.067 | 0.0206 | 0.0076 | 0.016 | 0.0002 | — | — | — | Sn: 0.001, Mo: 0.02 | 2.71 | 0.907 | 0.817 | Invention Example |
| N | 0.09 | 3.40 | 0.070 | 0.0228 | 0.0081 | 0.016 | 0.0002 | — | — | — | Sn: 0.001, Mo: 0.001 | 2.81 | 0.885 | 0.865 | Invention Example |
| O | 0.07 | 3.40 | 0.69 | 0.0218 | 0.0080 | 0.015 | 0.0002 | — | — | — | — | 2.73 | 0.950 | 0.892 | Invention Example |
| P | 0.08 | 3.40 | 0.71 | 0.0168 | 0.0080 | 0.015 | 0.0002 | — | — | — | — | 2.10 | 1.356 | 1.721 | Comparative Example |
| Q | 0.08 | 3.40 | 0.72 | 0.0259 | 0.0083 | 0.015 | 0.0002 | — | — | — | — | 3.12 | 1.082 | 1.033 | Comparative Example |

*In columns not indicated, content of Ni, Cu or Sn is 0.001 mass %, content of Te or Mo is 0.0002 mass %, and content of other element is 0.0001 mass %.

Test specimens for magnetic measurement are taken out from the product coil having a full length of about 4000 m thus obtained at 5 places of 0 m, 1000 m, 2000 m, 3000 m and 4000 m in its longitudinal direction to measure an iron loss value $W_{17/50}$ at a magnetic flux density of 1.7 T, in which the worst value of the iron loss among the five places is a guarantee value in coil and the best value thereof is a good value in coil. The results are also shown in Table 3.

As seen from Table 3, the iron loss property is more improved by adding one or more of Ni, Cu and Sb or further one or more of Ge, Bi, V, Nb, Tb, Cr, Sn and Mo, while the iron loss property is largely deteriorated when the ratio (sol. Al/N) is largely deviated from the given range.

Example 2

A steel slab having a chemical composition comprising C: 0.07 mass %, Si: 3.4 mass %, Mn: 0.07 mass %, sol. Al: 0.018 mass %, N: 0.007 mass %, Se: 0.015 mass %, Ni: 0.3 mass %, Cu: 0.03 mass % and Sb: 0.04 mass % is hot rolled to obtain a hot rolled sheet of 2.4 mm in thickness, which is subjected to hot band annealing at 900° C. for 40 seconds, pickled, subjected to a first cold rolling to a sheet thickness of 1.5 mm and further to an intermediate annealing at 1150° C. for 80 seconds and warm rolled at a temperature of 170° C. to obtain a cold rolled coil having a final sheet thickness of 0.17 mm. Then, the cold rolled coil is divided into two parts, wherein one part is subjected to a magnetic domain subdividing treatment by forming grooves, which have a width of 180 μm and extend in a direction perpendicular to the rolling direction, on the steel sheet surface at an interval of 5 mm in the rolling direction, while the other part is not subjected to the magnetic domain subdividing treatment. Thereafter, these parts are subjected to a primary recrystallization annealing combined with decarburization annealing in a wet atmosphere of 50 vol % $H_2$-50 vol % $N_2$. In the primary recrystallization annealing, the heating to 840° C. is performed by variously changing a heating rate from 200° C. to 700° C. within a range of 20-200° C./s as shown in Table 4. Moreover, the heating rate in the region of 200° C. to 700° C. is constant and 450° C. is held for 0.5-3 seconds on the way of the heating, while a portion of the coil is not subjected to the holding treatment.

TABLE 4

| | Heating conditions in primary recrystallization annealing | | Iron loss $W_{17/50}$ (W/kg) | | |
|---|---|---|---|---|---|
| No. | Heating rate (° C./s) | Holding time (s) | No magnetic domain subdivision | Magnetic domain subdivision | Remarks |
| 1 | 20 | 3 | 0.872 | 0.751 | Invention Example |
| 2 | 40 | 3 | 0.852 | 0.737 | Invention Example |
| 3 | 50 | 3 | 0.839 | 0.734 | Invention Example |
| 4 | 70 | 3 | 0.822 | 0.731 | Invention Example |
| 5 | 100 | 3 | 0.818 | 0.727 | Invention Example |
| 6 | 150 | 3 | 0.815 | 0.726 | Invention Example |
| 7 | 200 | 3 | 0.818 | 0.736 | Invention Example |
| 8 | 40 | 0 | 0.868 | 0.755 | invention Example |
| 9 | 60 | 0 | 0.854 | 0.749 | Invention Example |
| 10 | 50 | 0 | 0.851 | 0.738 | Invention Example |
| 11 | 100 | 0 | 0.862 | 0.751 | Invention Example |
| 12 | 60 | 0.5 | 0.851 | 0.743 | Invention Example |
| 13 | 60 | 1 | 0.838 | 0.733 | Invention Example |
| 14 | 60 | 2 | 0.836 | 0.732 | Invention Example |
| 15 | 60 | 3 | 0.834 | 0.731 | Invention Example |
| 16 | 60 | 5 | 0.837 | 0.734 | Invention Example |
| 17 | 60 | 10 | 0.842 | 0.735 | Invention Example |
| 18 | 60 | 15 | 0.859 | 0.755 | Invention Example |

Thereafter, the steel sheet is coated on its surface with an annealing separator composed mainly of MgO and subjected to final annealing by heating to 850° C. in $N_2$ atmosphere at a heating rate of 20° C./hr, holding at 850° C. for 50 hours, heating from 850° C. to 1150° C. in a mixed atmosphere of 50 vol % $N_2$-50 vol % $H_2$ and from 1150° C. to 1200° C. in $H_2$ atmosphere at a heating rate of 40° C./hr, soaking at 1200° C. in $H_2$ atmosphere for 10 hours and then cooling in a region of not higher than 800° C. in $N_2$ atmosphere. After the unreacted annealing separator is removed off from the steel sheet surface subjected to the final annealing, a liquid for tension film composed of 50 mass % colloidal silica and magnesium phosphate is applied and baked to form an insulation coating to thereby obtain a product coil.

Test specimens for magnetic measurement are taken out from the product coil having a full length of about 4000 m thus obtained at 5 places of 0 m, 1000 m, 2000 m, 3000 m and 4000 m in its longitudinal direction to measure an iron loss value $W_{17/50}$ at a magnetic flux density of 1.7 T and determine an average value thereof.

The measured results are also shown in Table 4 in terms of presence or absence of magnetic domain subdividing treatment. As seen from Table 4, the iron loss properties are further improved by properly adjusting the heating conditions in the final annealing and subjecting to the holding treatment in the heating process of the primary recrystallization annealing, and particularly the effect of improving the iron loss becomes remarkable by performing the magnetic domain subdividing treatment.

The invention claimed is:

1. A method for producing a grain-oriented electrical steel sheet comprising a series of steps of:

heating a steel slab having a chemical composition comprising C: 0.04-0.12 mass %, Si: 1.5-5.0 mass %, Mn: 0.01-1.0 mass %, sol. Al: 0.010-0.040 mass %, N: 0.004-0.02 mass %, one or two of S and Se: 0.005-0.05 mass % in total and the remainder being Fe and inevitable impurities to not lower than 1250° C., hot rolling to obtain a hot rolled sheet having a thickness of not less than 1.8 mm, subjecting the hot rolled sheet to a single cold rolling or two or more cold rollings including an intermediate annealing therebetween to obtain a cold rolled sheet having a final thickness of 0.15-0.20 mm, and subjecting the cold rolled sheet to primary recrystallization annealing and further to final annealing, wherein a content ratio of sol. Al to N in the steel slab (sol. Al/N) and a final thickness d (mm) satisfy the following formulas (1) and (2):

$$4d+1.52 \leq \text{sol. Al/N} \leq 4d+2.32 \quad (1)$$

$$\text{sol. Al/N} \leq 2.84 \quad (2)$$

and the steel sheet in the heating process of the final annealing is held at a temperature of 775-875° C. for 40-200 hours and then heated in a temperature region of 875-1050° C. at a heating rate of 20-60° C./hr, and wherein a region of 200-700° C. in the heating process of the primary recrystallization annealing is heated at a heating rate of not less than 50° C./s, while any temperature between 250-600° C. is held for 1-5 seconds.

2. The method for producing a grain-oriented electrical steel sheet according to claim 1, wherein the steel slab contains one or more selected from the group consisting of Ni: 0.1-1.0 mass %, Cu: 0.02-1.0 mass % and Sb: 0.01-0.10 mass %.

3. The method for producing a grain-oriented electrical steel sheet according to claim 2, wherein the steel slab contains 0.002-1.0 mass % in total of one or more selected from the group consisting of Ge, Bi, V, Nb, Te, Cr, Sn and Mo.

4. The method for producing a grain-oriented electrical steel sheet according to claim 3, wherein the steel sheet is subjected at any stage after the cold rolling to a magnetic domain subdividing treatment by forming grooves on the steel sheet surface in a direction intersecting with the rolling direction.

5. The method for producing a grain-oriented electrical steel sheet according to claim 3, wherein the steel sheet is subjected to a magnetic domain subdividing treatment by continuously or discontinuously irradiating electron beams or laser to a steel sheet surface provided with an insulation coating in a direction intersecting with the rolling direction.

6. The method for producing a grain-oriented electrical steel sheet according to claim 2, wherein the steel sheet is subjected at any stage after the cold rolling to a magnetic domain subdividing treatment by forming grooves on the steel sheet surface in a direction intersecting with the rolling direction.

7. The method for producing a grain-oriented electrical steel sheet according to claim 2, wherein the steel sheet is subjected to a magnetic domain subdividing treatment by continuously or discontinuously irradiating electron beams or laser to a steel sheet surface provided with an insulation coating in a direction intersecting with the rolling direction.

8. The method for producing a grain-oriented electrical steel sheet according to claim 1, wherein the steel slab contains 0.002-1.0 mass % in total of one or more selected from the group consisting of Ge, Bi, V, Nb, Te, Cr, Sn and Mo.

9. The method for producing a grain-oriented electrical steel sheet according to claim 8, wherein the steel sheet is subjected at any stage after the cold rolling to a magnetic domain subdividing treatment by forming grooves on the steel sheet surface in a direction intersecting with the rolling direction.

10. The method for producing a grain-oriented electrical steel sheet according to claim 8, wherein the steel sheet is subjected to a magnetic domain subdividing treatment by continuously or discontinuously irradiating electron beams or laser to a steel sheet surface provided with an insulation coating in a direction intersecting with the rolling direction.

11. The method for producing a grain-oriented electrical steel sheet according to claim 1, wherein the steel sheet is subjected at any stage after the cold rolling to a magnetic domain subdividing treatment by forming grooves on the steel sheet surface in a direction intersecting with the rolling direction.

12. The method for producing a grain-oriented electrical steel sheet according to claim 1, wherein the steel sheet is subjected to a magnetic domain subdividing treatment by continuously or discontinuously irradiating electron beams or laser to a steel sheet surface provided with an insulation coating in a direction intersecting with the rolling direction.

* * * * *